United States Patent [19]

Markus

[11] 4,185,418

[45] Jan. 29, 1980

[54] SLIDING DOOR, MEANT ESPECIALLY TO BE USED IN FIRE PROTECTION OR INSULATION

[75] Inventor: Jan J. Markus, Krimpen aan den Ijssel, Netherlands

[73] Assignee: Markus Hermetische Deuren B. V., Krimpen aan den Ijssel, Netherlands

[21] Appl. No.: 865,286

[22] Filed: Dec. 28, 1977

[51] Int. Cl.[2] ..... E06B 3/00

[52] U.S. Cl. ..... 49/501; 49/409; 52/475; 52/785

[58] Field of Search ..... 49/501, 409, 410, 411, 49/412; 52/613, 614, 624, 628, 475

[56] References Cited

U.S. PATENT DOCUMENTS

| | | | |
|---|---|---|---|
| 969,163 | 9/1910 | Hunter | 49/501 |
| 1,124,778 | 1/1915 | Meuler | 52/628 X |
| 1,979,309 | 11/1934 | Beiger | 52/614 |
| 3,058,173 | 10/1962 | Brydolf | 49/411 |
| 3,327,428 | 6/1967 | Horton et al. | 49/409 X |
| 3,383,799 | 5/1968 | Anderson | 49/501 X |
| 3,879,894 | 4/1975 | Anderson | 49/501 X |
| 3,879,912 | 4/1975 | Cox | 49/409 X |
| 4,031,665 | 6/1977 | Abramson | 49/501 |

*Primary Examiner*—Philip C. Kannan
*Attorney, Agent, or Firm*—Karl W. Flocks

[57] ABSTRACT

Sliding door, meant especially to be used in fire protection or insulation, whereby the sliding door comprises a framework consisting of a number of profiles on which framework panels are attached.

2 Claims, 1 Drawing Figure

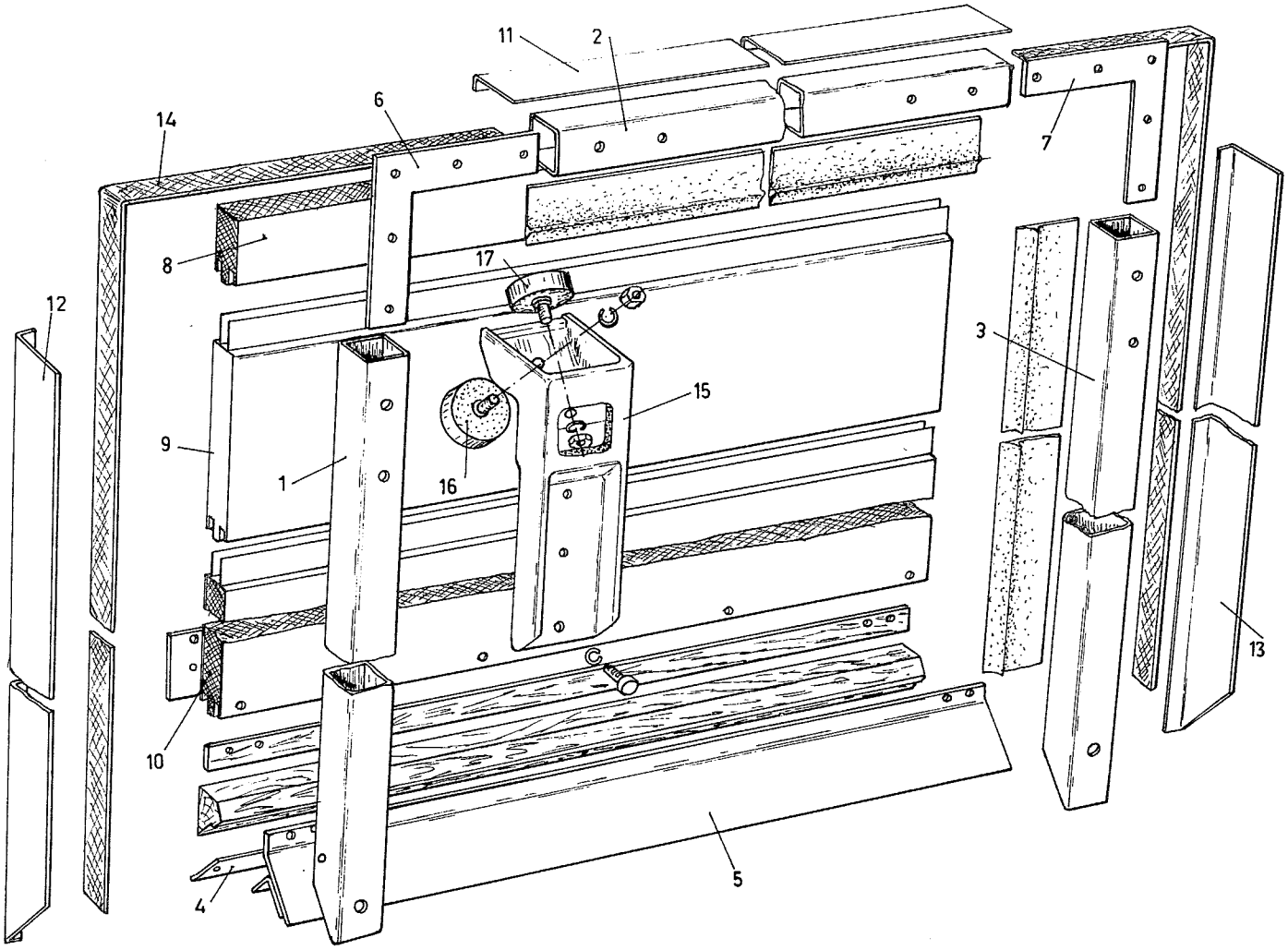
13
7
3
5
15
2
11
17
16
6
1
8
9
10
4
14
12

SLIDING DOOR, MEANT ESPECIALLY TO BE USED IN FIRE PROTECTION OR INSULATION

Sliding door, meant especially to be used in fire protection or insulation.

The invention relates to a sliding door, meant especially to be used in fire-proof, sound-proof or thermal insulation. Such sliding doors must be mounted hermetically against a doorcase construction. For this purpose, the sliding door must have a rigid contruction, which usually consists of a beam- and lath-construction which is put together unshrinkably by means of glue or screws and which as a front and a rear panel between which insulation material is provided in dependence on the use of the sliding door. Particularly with large sliding doors, this presents the disadvantage that these constructions are difficult to handle and transport, among other reasons because of their weight. Especially when long distance transportation is required, as in the case of export, these disadvantages become unacceptable.

The purpose of the present invention is to provide a sliding door, meant espcially to be used in fire-proof, sound-proof or thermal insulation, which can be prefabricated as a construction set in a workshop and which can be put together easily at the building-site.

For that purpose, the sliding door according to the invention is characterized in that the sliding door comprises a framework consisting of a number of profiles, on which framework panels are attached.

Such a construction offers the advantage that the entire construction can be prefabricated in th right dimensions at the factory, whereafter transportation as a construction set is simple, whereas the assembly at the building-site is possible in a simple manner, and yet a sliding door is obtained with sufficient rigidity to guarantee an hermetic sealing against the doorcase of the sliding door.

A favourable embodiment of the sliding door according to the invention is characterized in that the profiles are metal profiles, which at the top side of the door are connected to one another by corner pieces, whereas at the underside the profiles are connected to one another by a under guiding profile.

A further favourable embodiment of the sliding door according to the invention is characterized in that the panels are clamped against the profiles by means of corner profiles.

Another favourable embodiment of the sliding door according to the invention is characterized in that a rubber sealing profile is clamped between the panels and the corner profiles.

The invention will be explained hereinafter with reference to the drawing in which, by means of example, a preferable embodiment of the sliding door according to the invention is shown.

In the drawing the profiles are indicated by the reference numbers 1, 2 and 3, whereas the under guiding profile 4,5 at the under side is attached to the profiles 1 and 3 by means of screws. At the top side the profiles 1 and 2 are connected to one another by means of a corner piece 6 and the profiles 2 and 3 by means of a corner piece 7. On the thus obtained framework, panels 8,9,10 are attached, which panels are sealed against one another in a simple, known way. The panels are clamped on the framework by means of corner profiles 11, 12 and 13. Between the corner profiles and the door panel, a sealing profile 14, consisting e.g. of rubber, is clamped. At the top side of the thus assembled sliding door, a wheel bracket 15 is attached at each corner to the profile, with guiding wheels 16 and 17.

It will be obvious that the invention is not restricted to the above-given example of an embodiment, but that numerous modifications are possible, all within the scope of the invention.

I claim:

1. A sliding door constructed for use in fire protection or insulation comprising a framework including a pair of side vertical profiles connected to a top horizontal profile, an underguiding profile connected near the bottom of said side vertical profiles, corner pieces in the shape of flat right angles connecting said top horizontal profile at each of its ends to each of said side vertical profiles, framework panels interconnected to each other and attached to said profiles, corner profiles clamping said panels against said profiles, a web rubber sealing profile extending over the edges of said panels and clamped between said corner profile and said panels, and at least one wheel bracket with guiding wheels attached at a top corner of said framework.

2. The sliding door of claim 1 further characterized by said guiding wheels attached to said wheel bracket with their axes in non-parallel planes.

* * * * *